United States Patent [19]

Ikeda et al.

[11] 3,936,999

[45] *Feb. 10, 1976

[54] FALSE TWIST-CRIMPED POLYESTER YARNS PRODUCTION

[75] Inventors: Morio Ikeda; Mamoru Tsumoto, both of Ibaraki, Japan

[73] Assignee: Teijin Ltd., Osaka, Japan

[ * ] Notice: The portion of the term of this patent subsequent to Mar. 19, 1991, has been disclaimed.

[22] Filed: Dec. 19, 1973

[21] Appl. No.: 425,995

Related U.S. Application Data

[63] Continuation-in-part of Ser. No. 131,242, April 5, 1971, Pat. No. 3,797,221.

[52] U.S. Cl. ..... 57/157 TS; 57/140 R

[51] Int. Cl.[2] ..... D02G 1/02

[58] Field of Search..... 57/140 R, 140 BY, 157 R, 57/157 S, 157 TS, 55.5, 34 HS; 264/290 R, 290 N, 290 T, 103, 168

[56] References Cited

UNITED STATES PATENTS

| | | | |
|---|---|---|---|
| 2,980,492 | 4/1961 | Jamieson et al. | 57/157 S |
| 3,458,986 | 8/1969 | Allison et al. | 57/140 R |
| 3,534,541 | 10/1970 | Edison | 57/157 TS |
| 3,587,220 | 6/1971 | Eggleston | 57/140 R |
| 3,601,972 | 8/1971 | Rogers | 57/157 TS |
| 3,797,221 | 3/1974 | Ikeda et al. | 57/140 R |

FOREIGN PATENTS OR APPLICATIONS

| | | | |
|---|---|---|---|
| 746,992 | 3/1956 | United Kingdom | 57/157 S |

*Primary Examiner*—John Petrakes
*Attorney, Agent, or Firm*—Sherman & Shalloway

[57] ABSTRACT

A false twist-crimped polyester yarn having a density (d) of $1.3800 \leqq d \leqq 1.3970$ (g/cm$^3$) and total percentage crimp (TC) of TC 30% is produced by false twisting a polyester multi-filament having a birefringence ($\Delta n$) of $0.030 \leqq \Delta n \leqq 0.145$ while heat setting the filament in the twisted state at 160° to 210° at a draft (dr) which satisfies the following equation:

$$-150(\Delta n) + 17 \leqq dr \leqq 0.9 \times 10^4(\Delta n^2) - 29 \times 10^2(\Delta n) + 248.$$

3 Claims, 4 Drawing Figures

TOTAL CRIMP (%)
50
40
30
20
10
0
b2
a2
DYE EXHAUSTION (L VALVE)
50
45
40
35
30
a1
b1
ΔD
ΔT
ΔT
160
170
180
190
200
210
220
230
240
TEMPERATURE OF YARN (°C)
(ON THE HEATER)

180
160
140
120
100
80
60
40
20
0
20
DRAFT (dr)
dr=0.9x10^4(Δn)^2-29x10^2(Δn)+248
A2
A1
A3
dr=-150(Δn)+17
0
0.03
0.05
0.10
0.15
0.20
BIREFRINGENCE (Δn) OF STARTING YARN

FALSE TWIST-CRIMPED POLYESTER YARNS PRODUCTION

This application is a continuation-in-part of our application U.S. Ser. No. 131,242 filed on Apr. 5, 1971 now U.S. Pat. No. 3,797,221.

This invention relates to novel false twist-crimped polyester multifilament yarns having both highly improved total percentage crimp and highly improved dyeability, and to a process for producing such yarns.

It is known to produce a yarn of crimped polyester filaments by false twisting a travelling drawn polyester yarn and heat-setting the false-twist yarn before it passes through the false-twist means.

However, the known false twist-crimped polyester yarns do not have a satisfactory combination of crimp properties and dyeability. In the known process it is necessary to use high temperatures (usually 210°–230°C) to obtain adequate heat-setting to provide satisfactory crimp properties, and use of such temperatures results in deterioration of other properties of the yarn. In particular the yarns so produced have reduced dyeability (Dye exhaustion often is less than 80% with disperse dyes.) and even small variations in the heat-setting temperature result in yarns which have substantially non-uniform dyeability.

It is also known to modify false twist-crimped polyester yarns by subjecting them to a second heat-setting. However disadvantages as pointed out above remain in the modified yarns.

An object of the present invention is to provide a novel false twist-crimped polyester yarn having a very satisfactory combination of good crimp properties and level dyeability.

Another object of the present invention is to provide a process for producing such yarns which are simpler and cheaper to operate than the known process.

Many objects and advantages of the present invention will become apparent from the following description:

In its first aspect, the present invention provides a false twist-crimped polyester yarn having a density of 1.3800–1.3970 g/cm$^3$, a tensile strength of 2.0–5.0 g/denier, a breaking elongation of 20–60% and a total percentage crimp (TC) of at least 30%.

In its second aspect, the present invention provides a modified false twist-crimped polyester yarn having a density of 1.3800–1.3970 g/cm$^3$, a tensile strength of 2.0–5.0 g/denier, a breaking elongation of 20–60%, a total percentage crimp (TC) of not more than 20%, and a torque of between ⅔(TC) and 26 T/25 cm.

In its third aspect, the present invention provides a process for producing a falst twist crimped polyester yarn which comprises false twisting a polyester multifilament yarn having a birefringence ($\Delta n$) of 0.030–0.145, while heat-setting said multifilament yarn in the twisted state at 160°–210°C., at a draft (dr) expressed by the equation (I)

$$-150\,(\Delta n) + 17 \leqq dr \leqq 0.9 \times 10^4(\Delta n)^2 - 29 \times 10^2(\Delta n) + 248 \qquad (I)$$

In its fourth aspect, the present invention provides a process for producing a modified falst twist-crimped polyester yarn which comprises subjecting the false twist-crimped yarn obtained by this process to a second heat-setting at a temperature of 100°–230°C under the controlled relaxation.

In the known processes, the birefringence ($\Delta n$) of the starting polyester multifilament yarn has been at least 0.16 and it has not previously been suggested that draft should be varied according to the birefringence of the starting yarn. Furthermore, it has been necessary to heat-set the yarn, while it is being false-twisted, at higher temperatures of 210°–230°C.

We have found as a result of strenuous study, that by employing a starting yarn of lower birefringence between 0.030 and 0.145, a product of good crimp properties can be obtained at lower heat-setting temperatures of 160°–210°C, and furthermore by controlling yarn tension during heat-setting, by maintaining the draft ($dr$) within the range specified by the equation (I) above, the product has good, level dyeability as well as useful mechanical properties.

The birefringence ($\Delta n$), total percentage crimp (TC) and dye exhaustion (L-value) torque, density and mechanical properties are defined as follows:

A. Birefringence ($\Delta n$)

Sodium D rays (wavelength 589 millimicrons) are used as a light source, and the filaments are disposed in a diagonal position. The birefringence ($\Delta n$) of the specimen is computed from the following equation:

$$n = \frac{n\lambda + r}{\alpha}$$

where $n$ is the interference fringe due to the degree of orientation of the polymer molecular chain : $r$ is the retardation obtained by measuring the orientation not developing into the interference fringe by means of a Berek's compensator; $\alpha$ is the diameter of the filament; and $\lambda$ is the wavelength of the sodium D rays.

B. Total Percentage Crimp (TC)

The yarn is placed under two loads, a lighter load of 2 mg/denier and a heavier load of 0.2 g/denier. After a lapse of 1 minute, the length ($l_0$) is read. Immediately the heavier load is removed, and the yarn under the lighter load is placed in boiling water. It is taken out of the water 20 minutes later. The lighter load is removed, and the yarn is under ambient conditions dried for 24 hours. Both loads are again placed on the dried yarn, and its length ($l_2$) is measured after a lapse of 1 minute. Immediately, the heavier load is removed, and after a lapse of 1 minute, its length ($l_3$) is measured. The total percentage crimp (TC), which is the crimp properties of the false twist filaments, is expressed by the equation:

$$TC = \frac{l_2 - l_3}{l_0} \times 100\ (\%)$$

C. Dye exhaustion (L value)

The processed yarn is knitted on a circular knitting machine. The knitted artilce is dyed for 30 minutes in boiling water using a dye bath containing 3–4% of Eastmann Polyester Blue GLF and 0.5 g/liter of "Monogen" at a liquor ratio of 1:100. The lightness (L-value) of the dyeing is measured by a CM-20 type color differential meter of Nippon Color Machine Company. This L-value is employed as dye exhaustion. Larger L-values mean lighter colors, and smaller L-values mean darker colors.

D. Torque

A length of about 1 m of the yarn is held in a generally horizontal position and a load of 1 mg/denier is placed at the center of the yarn. The two ends of yarn are then brought together, which causes the two halves of the yarn to twist in a length ($y$) of the double twist yarn which contains two 25 cm lengths of yarn (i.e. one 25 cm length from each half of the yarn). Because the double yarn is shortened by the twisting together of the two levels, the length ($y$) is less than 25 cm. The number of turns can be determined visually or by turning the load until all the twist is removed and the average is taken.

E. Density

The yarn is put into a density gradient tube of n-heptane-carbon tetrachloride (25°C) using a float (made by Shibayama Scientific Instruments Works, Ltd.). The density is measured after a lapse of 48 hours.

F. Tensile Strength and Breaking Elongation

The tensile strength and breaking elongation are measured by the method according to JIS L 1069.

In order that the invention may be more clearly understood, reference may be made to the accompanying drawings in which.

Figure 1:
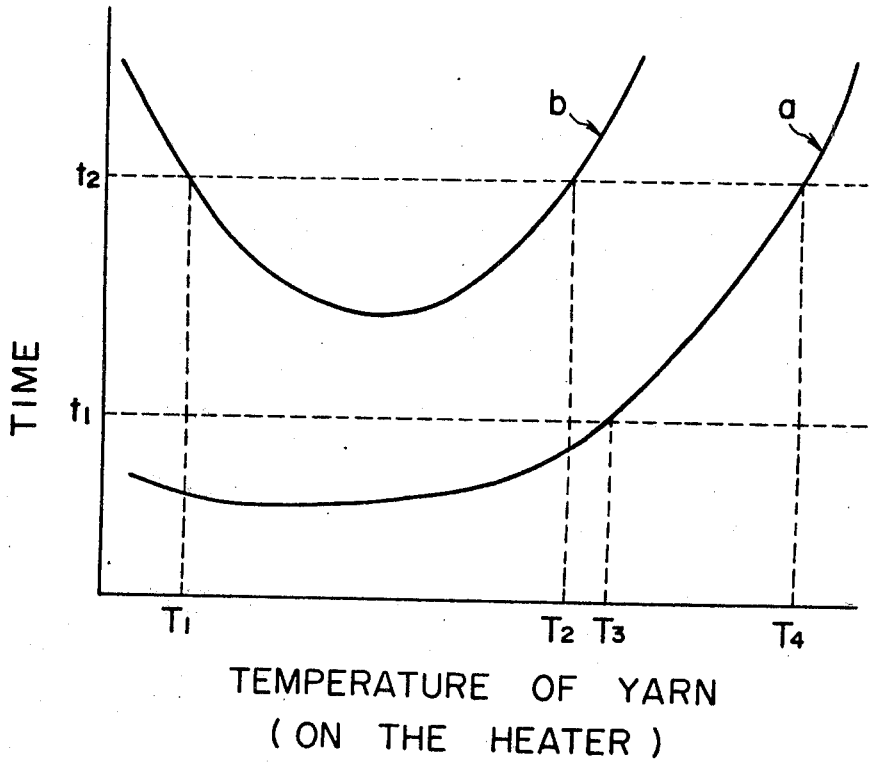
FIG. 1 shows the relationship between the heat-setting temperature (In this specification "the heat-setting temperature" means the temperature of the yarn during heat-setting) and the time needed to cause secondary crystallization.

Referring to FIG. 1, as abscissa is plotted the temperature of the yarn on the heater, and as ordinate the time needed to cause the secondary crystallization. The curve $a$ is for the conventional polyester yarn, and the curve $b$ is for the starting polyester yarn in the present invention. The denier size (de/fil), birefringence and draft of the yarns used are:

| | a | b |
|---|---|---|
| Denier size (de/fil) | 75/24 | 75/24 |
| Birefringence ($\Delta n$) | 0.168 | 0.085 |
| Draft (%) | −4 | 8 |

By the term "time need to cause secondary crystallization", we mean the time which elapses before a substantially straight line relation is established between the logarithm of the time elapsed and the density of the yarn. In order to obtain good crimps, the time should be between $t_1$ and $t_2$ and the secondary crystallization should not take place before crimps have set. It will be seen that for the conventional yarn, the temperature of the yarn during heat-setting must be from $T_3$ to $T_4$ (usually 210°–230°C) for these condition fulfilled, whereas for the starting yarn used in this invention the temperature is lower, namely from $T_1$ to $T_2$; this difference is presumably due to different crystalline structures.

Figure 2:
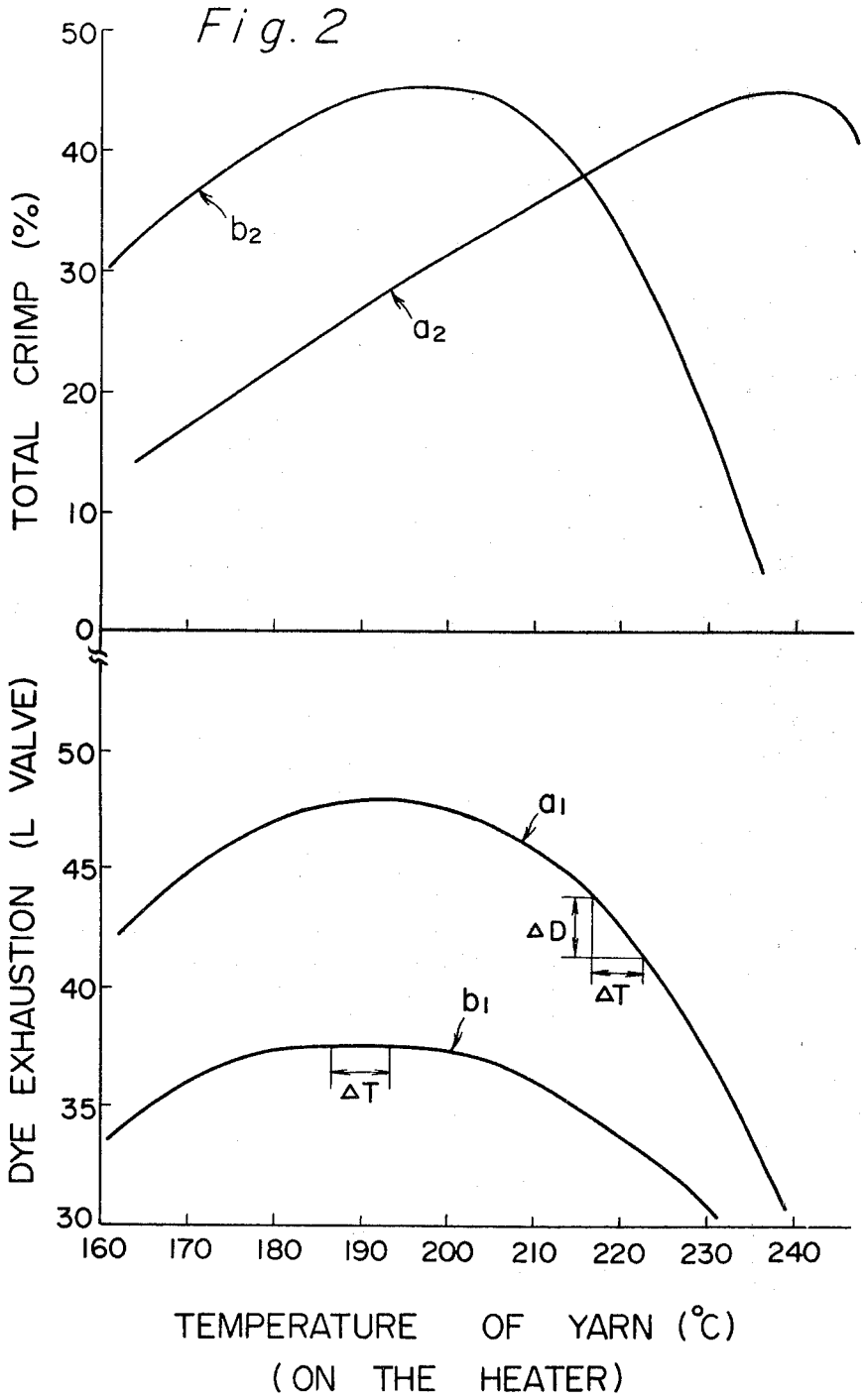
FIG. 2 shows one example of the relationship between the heat-setting temperature and dye exhaustion (L-value) and the total percentage crimp.

Referring now to the lower part of FIG. 2, the dye exhaustion of the yarn of the invention is shown by curve $b_1$ and the dye exhaustion of the conventional false twist-crimped polyester yarn by curve $a_1$. It will be seen that the novel yarn of this invention has dyeability that not only is better than that of the conventional yarn but also varies much less with variations at the heat-setting temperature employed to give good crimps.

Referring now to the upper part of FIG. 2, the curves $a_2$ and $b_2$ represent the total percentage crimps (TC) of the crimped yarns corresponding to $a_1$ and $b_1$. The TC of the crimped yarn of the invention becomes maximum at a temperature in the range of 160°–210°C, especially 175°–205°C., within which excellent level dyeability can be obtained. In contrast, with the conventional false twist-crimped polyester yarns having a density of 1.398–1.410, the total percentage crimps become maximum at 210°–220°C., and above, at which heat-setting temperatures the crimped polyester yarns suffer from large fluctuations in dyeing difference ($\Delta D$) with the temperature difference ($\Delta T$) and also reduced dye exhaustion.

Figure 3:
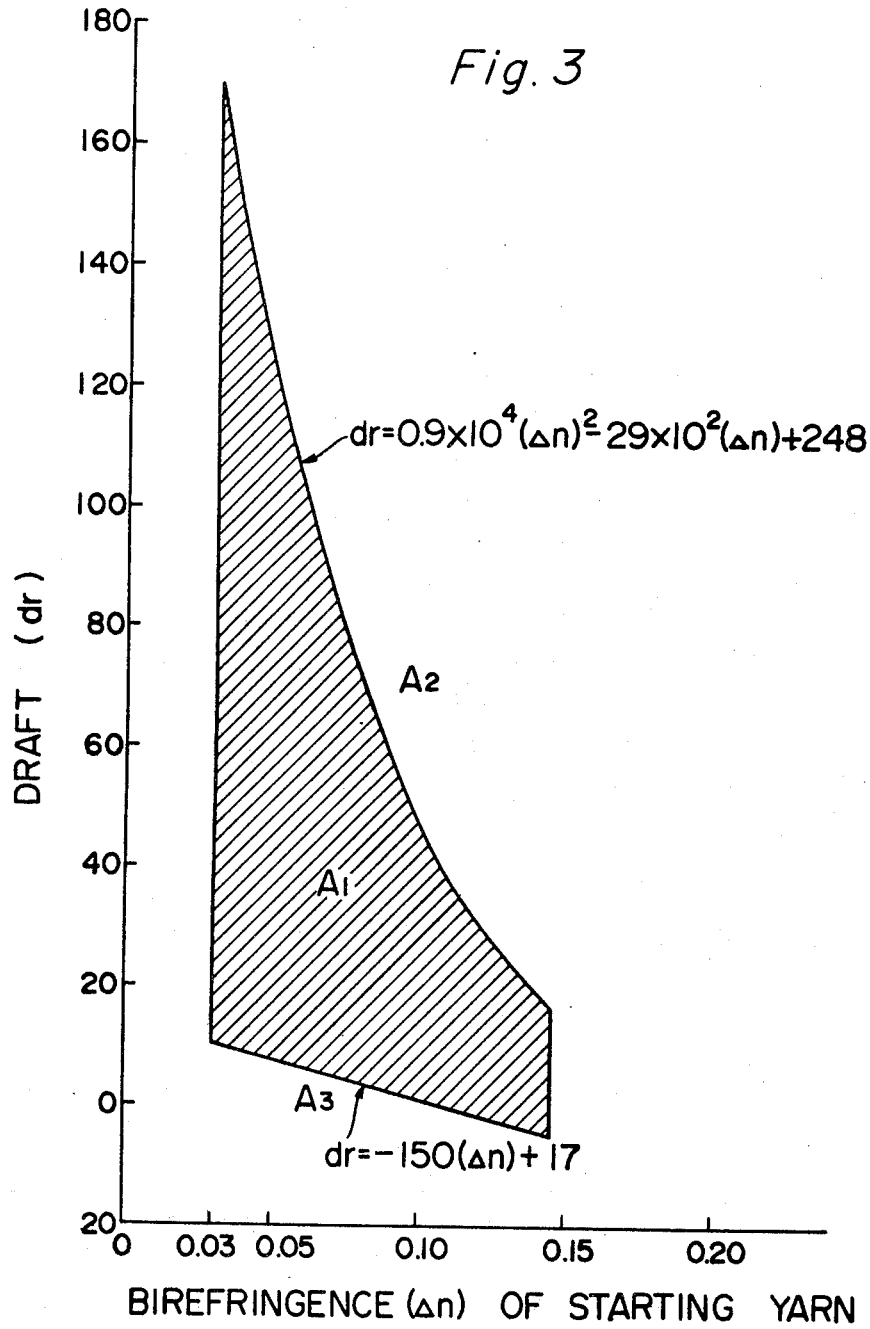
FIG. 3 shows the relationship between the birefringence of the starting yarn and the draft ($dr$)

Referring now to FIG. 3, the shaded area $A_1$ shows the drafts that are employed in this invention. This corresponds to yarn tension during twisting of 0.05–0.50 g/denier.

In the area designated $A_3$, the yarn tension is too low and the product contains tight-spots (untwisted filaments and melt-adhered filaments). In the area $A_2$, the tension is too high and the product has poor crimp characteristics and fluffs.

Figure 4:
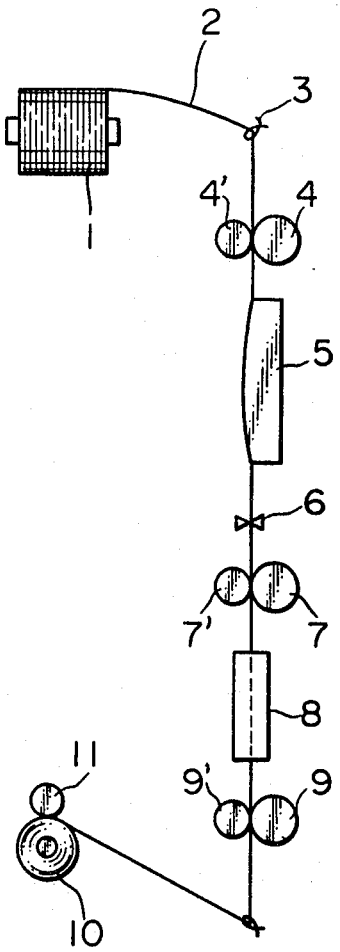
FIG. 4 shows diagrammatically one example of apparatus suitable for use in the present invention.

Referring to FIG. 4, starting polyester multifilament yarn 2 is withdrawn from package 1, through the snail guide 3 and is delivered by a pair of feed rollers 4 and 4'. It then passes first heater 5 and false twist means (such as spindle) 6, and is then taken up by a pair of first delivery rollers 7 and 7'. It passes second heater 8 and the second delivery rollers 9, 9' if desired, and then is wound up on bobbin 10 which is rotated frictionally by roller 11. Generally draft ($dr$) is determined by the following equation:

$$\text{draft } (dr) = \frac{V_2 - V_1}{V_1} \times 100\ (\%)$$

wherein $V_1$ is the peripheral speed of feed rollers 4, 4' and $V_2$ is the peripheral speed of first delivery rollers 7, 7'.

The type of the false twist-crimping is not critical, but the spindle method is especially preferred. If desired, second heater 8 may be provided between first delivery rollers 7, 7' and second delivery rollers 9, 9', in order to heat-set the crimped yarn at a temperature of 100°–230°C, preferably 160°–220°C, under the controlled relaxation e.g. under the condition allowing shrinkage of 0–40%, preferably 5–35%, and reduce the torque and shrinkage of the said yarn.

The starting yarn for the process of the invention can be undrawn multifilament yarn obtained by high-speed melt spinning of polyester. In this method, undrawn polyester yarn extruded through a spinneret can be drawn and wound up on a bobbin rotating at a peripheral speed of 2500–5000 m/min., preferably about 3000 m/min. In the high-speed melt spinning process, polyester yarn extruded through a spinneret, after cooling to the temperature of the second transition point, may be heated in the spinning chamber, or on the withdraw rollers.

The undrawn yarns used in the present invention may be those obtained by high-speed melt spinning of the polyester containing at least 80 mole % of ethylene terephthalate, preferably polyethylene terephthalate.

Especially preferred are those having a denier size of 0.5–150 denier monofilament, and an intrinsic viscosity of 0.3–1.2, as computed from the value measured in o-chlorophenol at 35°C.

The undrawn yarn may have not only a circular cross-section, but also a non-circular cross-section such as a triangular or flat and hollow section.

Thus according to the present invention, a low torque false twist-crimped polyester yarn having highly improved dyability, good crimping properties and useful mechanical properties. A particular advantage of the process of the invention is that, because lower yarn temperatures are needed in heat-setting, higher operating speed is possible.

The invention will further described by the following Examples:

EXAMPLE 1–10

Polyethylene terephthalate chips having an intrinsic viscosity of 0.65 were melted at 285°C., and extruded through a spinneret having 30 orifices each having a diameter of 0.4 mm at 285°C, followed by winding up at the speeds shown in Table 1, and then the undrawn yarns were false twist-crimped using the machine shown in FIG. 4.

The properties of the undrawn yarns, the false-twist-crimping conditions and the properties of the false-twist crimped yarns are shown in Table 1, in which the number of false twist turns (T/M) is the amount of twist in turns per meter inserted by the false twist spindle.

TABLE 1

| | EXAMPLE | 1 | 2 | 3 | 4 | 5 | 6 | 7 | 8 | 9 | 10 |
|---|---|---|---|---|---|---|---|---|---|---|---|
| | Spinning speed (m/min) | 2500 | 3000 | 3500 | 4000 | 5000 | 3000 | 3000 | 3000 | 3500 | 3500 |
| Undrawn yarn | Size of denier (d/fil) | 300/30 | 255/30 | 231/30 | 195/30 | 171/30 | 210/30 | 240/30 | 300/30 | 231/30 | 231/30 |
| | Birefringence (Δn) | 0.030 | 0.038 | 0.052 | 0.065 | 0.089 | 0.041 | 0.039 | 0.037 | 0.052 | 0.052 |
| | Density (g/cm³) | 1.3440 | 1.3490 | 1.3515 | 1.3585 | 1.3720 | 1.3505 | 1.3494 | 1.3485 | 1.3515 | 1.3515 |
| | Tensile strength (g/d) | 2.04 | 2.48 | 2.80 | 3.15 | 3.50 | 2.55 | 2.50 | 2.25 | 2.80 | 2.80 |
| | Tensile elongation (%) | 245 | 190 | 152 | 125 | 105 | 175 | 190 | 200 | 152 | 152 |
| False twist-crimping conditions | Draft (%) | 100 | 70 | 54 | 30 | 14 | 40 | 60 | 100 | 54 | 54 |
| | First heat-setting temperature(°C)(temp. of yarn) | 190 | 190 | 190 | 190 | 190 | 190 | 190 | 190 | 170 | 200 |
| | Number of twist (T/M) | 2600 | 2600 | 2600 | 2600 | 2600 | 2600 | 2600 | 2600 | 2600 | 2600 |
| | Speed of first delivery roller (m/min) | 200 | 200 | 200 | 200 | 200 | 200 | 200 | 200 | 200 | 200 |
| | Second heat-setting temperature (°C) | 200 | 200 | 200 | 200 | 200 | 200 | 200 | 200 | 200 | 200 |
| | Speed of second delivery roller | 172 | 172 | 172 | 172 | 172 | 172 | 172 | 172 | 172 | 172 |
| | Twist tention (gr) | 30 | 34 | 32 | 30 | 35 | 21 | 30 | 55 | 32 | 31 |
| Properties of crimped yarn | Density (g/cm³) | 1.3910 | 1.3925 | 1.3905 | 1.3899 | 1.3908 | 1.3908 | 1.3919 | 1.3921 | 1.3851 | 1.3935 |
| | Total percentage crimp (%) standard spindle (TCs) | 12.5 | 12.8 | 12.4 | 12.2 | 12.5 | 13.4 | 12.6 | 10.8 | 11.4 | 13.8 |
| | crimp difference (ΔTC) | 1.0 | 1.0 | 1.0 | 1.0 | 1.0 | 1.0 | 1.0 | 1.0 | 1.0 | 1.0 |
| | Dyeing properties standard spindle (Ds) | 38.6 | 39.0 | 38.5 | 39.2 | 38.6 | 38.7 | 38.2 | 36.8 | 38.6 | 38.6 |
| | dyeing difference (ΔD) | 0.2 | 0.2 | 0.2 | 0.2 | 0.2 | 0.2 | 0.2 | 0.2 | 0.2 | 0.2 |
| | Torque (T/25 cm) | 14 | 14 | 14 | 14 | 15 | 15 | 14 | 13 | 14 | 16 |
| | Tensile strength (g/d) | 3.85 | 3.75 | 3.85 | 3.70 | 3.90 | 3.70 | 3.76 | 3.95 | 3.90 | 3.85 |
| | Tensile elongation (%) | 32 | 34 | 32 | 33 | 34 | 35 | 34 | 30 | 33 | 32 |
| | Size of denier (d/fil) | 160/30 | 161/30 | 160/30 | 160/30 | 159/30 | 160/30 | 160/30 | 158/30 | 161/30 | 160/30 |

EXAMPLE 11–16

Polyethylene terephthalate chips having an intrinsic viscosity of 0.65 were melt spun at 285°C, through a spinneret having 30 orifices each having a diameter of 0.4 mm, into a spinning chamber in which middle part is heated, followed by winding up at the speeds shown in Table 2. And then, the obtained undrawn yarns were false twist crimped using the machine shown in FIG. 4.

The spinning conditions, properties of undrawn yarns, false twist crimping conditions, and the properties of the false twist crimped yarns, are shown in Table 2.

TABLE 2

| | EXAMPLE | 11 | 12 | 13 | 14 | 15 | 16 |
|---|---|---|---|---|---|---|---|
| Spinning Conditions | Spinning speed (m/min) | 3700 | 3700 | 3700 | 2000 | 3000 | 4000 |
| | Temp. of the middle part in the spinning chamber (°C) | 150 | 170 | 190 | 170 | 170 | 170 |
| | Temp. of the with-draw rollers (°C) | 25 | 25 | 25 | 25 | 25 | 25 |
| Undrawn yarn | Size of denier (d/fil) | 180/30 | 173/30 | 165/30 | 195/30 | 180/30 | 165/30 |
| | Birefringence (Δn) | 0.105 | 0.118 | 0.126 | 0.068 | 0.095 | 0.124 |
| | Density (g/cm³) | 1.3660 | 1.3685 | 1.3704 | 1.3621 | 1.3649 | 1.3700 |
| False twist-crimping conditions | Draft (%) | 20 | 15 | 10 | 30 | 20 | 10 |
| | First heat-setting temp. (°C.) | 190 | 190 | 190 | 190 | 190 | 190 |
| | Number of twist (T/M) | 2600 | 2600 | 2600 | 2600 | 2600 | 2600 |
| | Speed of first delivery roller (m/min) | 200 | 200 | 200 | 200 | 200 | 200 |
| | Second heat-setting temp. (°C) | 200 | 200 | 200 | 200 | 200 | 200 |
| | Speed of Second delivery roller (m/min) | 172 | 172 | 172 | 172 | 172 | 172 |

TABLE 2-continued

| | EXAMPLE | 11 | 12 | 13 | 14 | 15 | 16 |
|---|---|---|---|---|---|---|---|
| | Twist tension (gr) | 34 | 36 | 35 | 36 | 35 | 36 |
| Properties of crimped yarns | Density (g/cm³) | 1.3912 | 1.3913 | 1.3907 | 1.3930 | 1.3926 | 1.3927 |
| | Total percentage crimp (%) | | | | | | |
| | Standard spindle (TCS) | 12.4 | 12.3 | 12.4 | 12.0 | 12.3 | 12.1 |
| | Crimp difference (ΔTC) | 1.0 | 1.0 | 1.0 | 1.0 | 1.0 | 1.0 |
| | Dyeing properties | | | | | | |
| | Standard spindle (Ds) | 36.8 | 37.0 | 36.6 | 37.5 | 37.8 | 37.3 |
| | Dyeing difference (ΔD) | 0.2 | 0.2 | 0.2 | 0.2 | 0.2 | 0.2 |
| | Torque (T/25 cm) | 18 | 19 | 18 | 16 | 17 | 16 |
| | Tensile strength (g/d) | 4.20 | 4.45 | 4.50 | 3.90 | 4.07 | 4.30 |
| | Tensile elongation (%) | 28 | 30 | 29 | 34 | 33 | 30 |
| | Size of denier (d/fil) | 160/30 | 160/30 | 161/30 | 160/30 | 159/30 | 160/30 |

We claim:

1. A process for producing a false twist-crimped polyester yarn which comprises false twisting undrawn polyester multifilament yarn obtained by melt-spinning at a speed of 2500–5000m/min., having a birefrigence ($\Delta n$) of 0.030–0.145 and a density of not greater than 1.3720, while heat-setting said yarn in the twisted state at a first temperature of 160°–210°C, at a draft ($dr$) expressed by the equation:

$$-150(\Delta n) + 17 \leqq dr \leqq 0.9 \times 10^4(\Delta n^2) - 29 \times 10^2(\Delta n) + 248$$

and then subjecting the false twist-crimped yarn to a second heat-setting temperature.

2. A process according to claim 1 wherein a modified false twist-crimped yarn is produced by subjecting the false-twist crimped yarn to a second heat setting temperature of 100°–230°C under controlled relaxation conditions.

3. A process according to claim 1 wherein the amount of relaxation in the second heat setting is 0–40% based on the length of the false twist-crimped yarn.

* * * * *